US006308935B1

(12) United States Patent
Rocheford

(10) Patent No.: US 6,308,935 B1
(45) Date of Patent: Oct. 30, 2001

(54) STAPLE REMOVING TOOL

(75) Inventor: Michael D. Rocheford, Dayton, MN (US)

(73) Assignee: The Upholstery Studio, Inc., Brooklyn Park, MN (US)

( * ) Notice: Subject to any disclaimer, the term of this patent is extended or adjusted under 35 U.S.C. 154(b) by 0 days.

(21) Appl. No.: 09/479,092

(22) Filed: Jan. 7, 2000

(51) Int. Cl.[7] ..... B25C 11/00
(52) U.S. Cl. ..... 254/28
(58) Field of Search ..... 254/28, 131, 25; 29/267

(56) References Cited

U.S. PATENT DOCUMENTS

| | | | | |
|---|---|---|---|---|
| 3,310,288 | | 3/1967 | Berry . | |
| 3,583,673 | * | 6/1971 | Poskin | 254/28 |
| 4,293,119 | | 10/1981 | Diederichs . | |
| 4,637,538 | | 1/1987 | Wagner . | |
| 4,930,749 | | 6/1990 | Lawrence . | |
| 5,031,881 | | 7/1991 | Thurmston . | |

* cited by examiner

*Primary Examiner*—Robert C. Watson
(74) *Attorney, Agent, or Firm*—Nawrocki, Rooney & Sivertson, P.A.

(57) ABSTRACT

A tool for removing a staple including a shank having an axis of elongation and a distal end along said axis of elongation. A ramp, having a surface for engaging an underside of the crown portion of a staple, is formed integrally with the shank proximate the distal end thereof. The ramp extends laterally with respect to the shank axis of elongation and has an axis angling away from the axis of elongation of the shank at an acute angle. A first fulcrum is integrally formed in the shank, generally perpendicular to the axis of said ramp, about which the ramp can be rotated when the engaging surface abuts an underside of a crown portion of the staple. A second fulcrum is integrally formed in the shank, generally perpendicular to the axis of elongation of the shank, about which the ramp can be rotated when the engaging surface abuts an underside of the crown portion of the staple.

19 Claims, 3 Drawing Sheets

STAPLE REMOVING TOOL

TECHNICAL FIELD

The present invention relates to a staple removing tool, more particularly to a staple removal tool designed to remove staples from furniture, as during re-upholstering operations, without risk of marring the wood or fabric surfaces thereof.

BACKGROUND OF INVENTION

With heightened interest in antique furniture and heirloom pieces, coupled with a greater interest in recycling and reuse, greater demands are being made for quality furniture repair and restoration services. Such services are primarily provided by professional furniture builders, reupholsterers, boat and auto upholstery shops, etc., and to a lesser extent by hobbyists and do-it-yourselfers.

One of the least forgiving tasks associated with re-upholstering furniture has been staple removal. One misplacement, slip or errant thrust of a staple removing tool can create additional restoration work or even ruin a valuable piece of furniture. It is critical that the high quality, and oftentimes decorative wood typically found, for instance, where the fabric is stapled into a groove (e.g., about a quarter inch in width) in the back of the chair, be preserved. Gouging or otherwise marring the wood during this process, or when pulling staples placed in error, must be avoided at all cost. This could mean the difference in the actual worth of the piece since none of the wood is marred in the reupholstering phase of refinishing the piece.

Known tools for removing staples can make wood preservation a challenge. Heretofore known tools are characterized by sharp edges or sharp points, or both, for raising the bridge or bight portion of a staple from a work piece. Tools having chisel type bits insertable under the bight portion of a staple are well known. These sharp, pointed bit type tools are positioned at a 90 degree angle to the bight portion of the staple and "hammered" or "slammed" thereunder, either by hand or by known mechanical or pneumatic means.

A widely used bit type tool is that disclosed in U.S. Pat. No. 3,310,288 issued to Berry. It has a head or fork portion comprising spaced apart knife and crimp points. The longitudinal axis of the tool is aligned perpendicular to the bight portion of the staple, with the knife point hammered thereunder to upwardly lift the staple by a wedging action of the knife point. Thereafter, rotation of the tool about the longitudinal axis (i.e., moving the fork in a lateral direction), until the free edge of the fork engages the work piece, causes the crimping point to engage and crimp the bight of the staple. This action effectively shortens the bight of the staple, causing upward lift in a leg, with further 180 degree rotation required to remove the other leg (i.e., both staple legs) from the work piece. In addition to the sharp points and edges of this tool which are potentially detrimental to the finish of the work piece, the rotating, pole-vault type action of the fork edges against the work piece, at least once and more likely twice—in a separate spot on the work piece, is unacceptable, and such style of tool is particularly unfit when removing staples from a non-flat surface, as surface gouging is certain.

Jawed tools are also known for the removal of staples from furniture and the like. As with bit type tools, jawed tools are intended to be perpendicularly aligned relative to the bight portion of the staple for slamming or otherwise forcing a pointed lower jaw thereunder such that the bight might be grasped by the opposing jaws and the staple removed. Typically the lower jaw further functions as a moment arm as it pivotally engages the work piece, with subsequent pulling or twisting necessary to remove the legs, and thus the staple, from the work piece. Here, as with bit type tools, there exists a great probability for damaging the wood and or fabric, as when pulling staples placed in error etc., with such a tool, even when skillfully used by a craftsperson. Furthermore, such jawed tools are undesirable for removing staples from a curved or grooved work piece, as damage to the furniture finish is almost certain.

SUMMARY OF THE INVENTION

A tool for removing a staple including a shank having an axis of elongation and a distal end along said axis of elongation. A ramp, having a surface for engaging an underside of the crown portion of a staple, is formed integrally with the shank proximate the distal end thereof. The ramp extends laterally with respect to the shank axis of elongation and has an axis angling away from the axis of elongation of the shank at an acute angle. A first fulcrum is integrally formed in the shank, generally perpendicular to the axis of said ramp, about which the ramp can be rotated when the engaging surface abuts an underside of a crown portion of the staple. A second fulcrum is integrally formed in the shank, generally perpendicular to the axis of elongation of the shank, about which the ramp can be rotated when the engaging surface abuts an underside of the crown portion of the staple.

More specific features and advantages will become apparent with reference to the DETAILED DESCRIPTION OF THE INVENTION, appended claims, and the accompanying drawing figures.

DETAILED DESCRIPTION OF THE INVENTION

Figure 1:
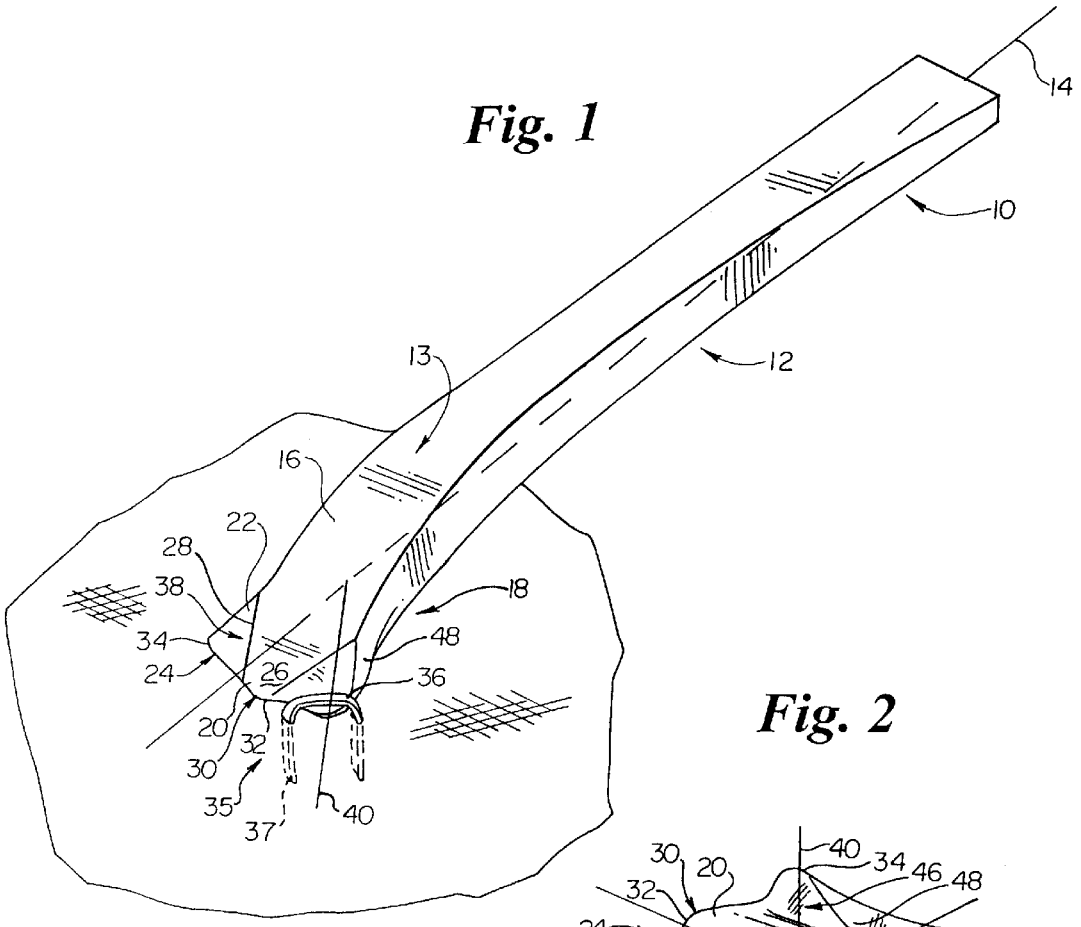
FIG. 1 is a perspective view of the tool of the subject invention illustrating its engagement with a bight portion of a staple in a flat surface of a work piece.

Referring to FIG. 1, the staple removing tool 10 of the subject invention has a shank or shaft 12 having an axis of elongation 14 and a distal end 16 along the axis of elongation 14, and a staple removing head 18 positioned at the distal end 16 of the shaft 12 and integral therewith. The staple removing head 18 has a central projecting nose 20 which is substantially aligned with the axis of elongation 14 of the shaft 12. Staple prying ramps or lobes 22 laterally extend with respect to, and are spaced apart by, the central projecting nose 20 so as to define an irregular perimeter 24 for the staple removing head 18.

The shank 12 of the staple removing tool 10 is preferable a square steel slug, with a generally tapered (i.e., beveled) contoured distal end or tip, specially configured to efficiently remove staples from both flat and non-flat surfaces with minimal damage (e.g., gouging, scratching, etc.). In furtherance of ergonomic considerations, the shank 12 preferably possesses a slight bend 13, which is preferably in the range of about 10 to 20 degrees, such that the staple removing head 18 is positioned somewhat "below" but nonetheless aligned with the axis of elongation 14 so as to provide enhanced leverage for staple removal (i.e., it allows the tool to be held with the arm straight and the tool bending to do the work.)

Although a steel slug of square cross section is contemplated, it is in no way limiting. Shanks of various cross sections (e.g., rectangular, elliptical, round, etc.) are feasible, with production (i.e., manufacturing) costs likely being determinative. Likewise, although steel, in its broadest sense, is contemplated, it is not to be considered limiting as other fabrication materials possessing the characteristics of steel, most notably hardness, are satisfactory to fabricate the tool of the subject invention.

A hand grip or handle (not shown) is contemplated, but is not a necessary feature of the staple removing tool. It will be apparent that the handle may be formed of any suitable substantially rigid material, such as wood, plastic, metal, rubber, or composite of any such materials, into which the shank is firmly secured. Although the position (i.e., extent) of the handle along the shank is not critical, it is preferable that the shank exit the handle at a position rearward of the bend in the shank so as to maintain the ergonomic advantage.

Figure 2:
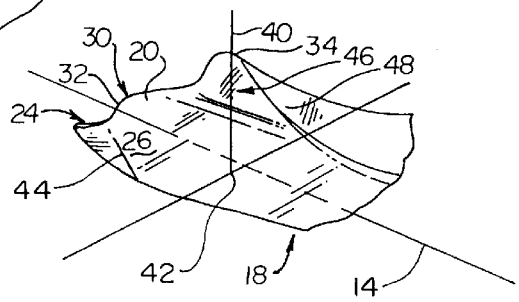
FIG. 2 is a partial view of the underside of the head of the tool.

Referring now to FIGS. 1 & 2, the central projecting nose 20 of the staple removing head 18 is substantially aligned with the axis of elongation 14 of the shank 12. The central projecting nose 20 preferably includes converging planar surfaces 26 (i.e., a flat top and bottom) and converging lateral edges 28 which merge to thereby form a flat tip 30 having a curved outer perimeter 32. The curved outer perimeter 32 of the projecting nose 20 is the forward most structure of the tool 10, as it is the leading edge of the irregular perimeter 24 of the staple removing head 18. As will be explained later in relation to FIGS. 3 through 5*a*, the tip 30 of the central projecting nose 20 defines a pivot point about which the tool 10 is swung for t he removal of staples from a work piece.

The staple prying ramps 22 of the tool 10 extend laterally with respect to the shank axis of elongation 14 and are spaced apart by the central projecting nose 20 of the staple removing head 18 (i.e., the ramps 22 are contiguous with, and thereby delimited by the converging lateral edges 28 of the central projecting nose 20). Each of the ramps 22 have a rounded perimeter 34 (i.e., a configuration well suited for engaging the crown portion 36 of a staple 35 in a furniture friendly manner) and a generally concave surface 38 (i.e., one that upwardly extends from the converging lateral edges 28 of the central projecting nose 20 in a non-linear fashion) for engaging, and to some degree retaining, the underside of the bight (i.e., bridge or crown) portion of a staple. The staple retaining function of the lobes 22 may be enhanced via a textured segment (e.g., score lines, notches, grooves, etc.) of perimeter edge 34 in the rearward most portion (i.e., near the convergence point of the perimeter edge 34 and converging lateral edges 28 of the central projecting nose 20) which aids in holding the bight 36 of staple 35.

Each of the ramps 22 further has it own axis 40 (i.e., a ramp axis) angling away from the axis of elongation 14 at an acute angle (e.g., about 20 to 30 degrees). First 42 and second 44 fulcrums (FIG. 2), about which the ramps 22 can be rotated when an engaging surface 38 of a ramp abuts the underside of the bight portion 36 of the staple 35, are integrally formed in the shank 12. The first fulcrum 42 is generally perpendicular to the axis of the ramp 40, more particularly being defined by the intersection of the flat bottom of the central projecting nose 20 (i.e., one of the converging planar surfaces 26) and the underside of the shank 12. The second fulcrum 44 is generally perpendicular to the axis of elongation 14 of the shank 12, more particularly being defined by the intersection of the underside 46 of the ramp 22 with the flat bottom of the central projecting nose 20 (i.e., one of the converging planar surfaces 26). The second fulcrum 44 generally underlays a converging lateral edge 28 of the central projecting nose 20, compare FIGS. 1 and 2.

In addition to the surface for engaging the underside of the bight portion of a staple 38, each of the ramps 22 has a second or underside surface 46, angularly diverging from the staple engaging surface 38, beginning at the tip 30 of the ramp 22. Preferably the staple engaging surface 38 and the underside surface of the ramp 46 diverge from one another at a relatively great degree to thereby form a not insubstantial wedge 48, particularly well suited for forcing an engaged staple to begin separating and lifting from the work piece with a much slighter twist of the wrist (i.e., about the second fulcrum 44) when compared to other known staple removing tools. Preferably, but not necessarily, the underside of the ramps 46 are curved as the corresponding curved surface thereof, rounding upwardly and angularly away from the axis of elongation 14 of the shank 12, in a direction substantially in alignment with the axis of each of the ramps 40.

With reference to FIGS. 3 through 5*a*, the tool of the subject invention is shown prying a staple 35 from a channel or groove 50, an environment especially well suited, but not limiting, for staple removal using said tool, and one commonly encountered when reupholstering chairs. Prior to reciting the specific mechanics or steps of staple removal, several general observations about the relationship between the tool and the work piece are in order.

First, it is important to note that throughout the pivot or vaulting motion of the tool 10 about the tip 30 of the central projecting nose 20, the staple removing head 18 does not engage the sidewalls 52 and or the edges 54 of the channel 50 (i.e., the staple removing head 18 remains substantially within a plane—vertical space—delimited in this application by the floor 56 of the channel). Second, the prying motion of the tool is in the direction of the bight of the staple, which is also in the direction of the elongation of the channel. It is further noted that throughout the prying motion of the tool, namely pivoting in the direction of the bight of the staple, the shank 12, and more particularly the axis of elongation 14 of the shank 12, need only deviate +/− about 10 degrees from the vertical (i.e., to the left or right of the channel elongation, as best seen in FIG. 4*a*) to effect quick and efficient removal of staples from the channel, thereby eliminating and certainly minimizing contact between the shank and the channel throughout the prying motion of the tool.

Figure 3:
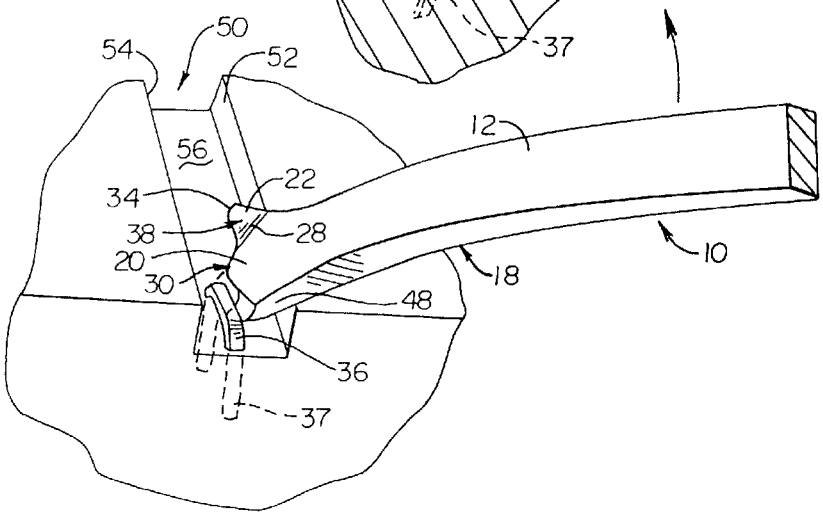
FIG. 3 is a perspective view of the tool of the subject invention illustrating its initial engagement with a bight portion of a staple positioned in the bottom of a channel.

To extract a staple, the tool must first engage the staple. Subsequent to insertion of the staple removing head 18 into the channel 50, either of the lobes 22 can be slid under the bight 36 of the staple 35, as illustrated in FIG. 3. As described herein above, the lobes 22 in particular, and the tool 10 more generally, have no sharp points or edges to mark or otherwise damage the work piece, which has heretofore been a concern, especially when engaging the staple for subsequent removal. A gentle "rocking" motion about the second fulcrum 44, which, as previously noted, generally underlays the converging lateral edges 28 of the central projecting nose 20 so as to correspond therewith, in combination with the unique lobe geometry, namely the overall wedge-like configuration and curved surfaces of the lobe, complete the engagement and facilitate a "break" between the staple and the work piece, which can be critical as oftentimes glue is used to further secure the staple in place. Again, tool motions parallel, or substantially parallel to the staple (i.e., the bight or head of the staple) impart prying forces for staple removal.

Figure 4:
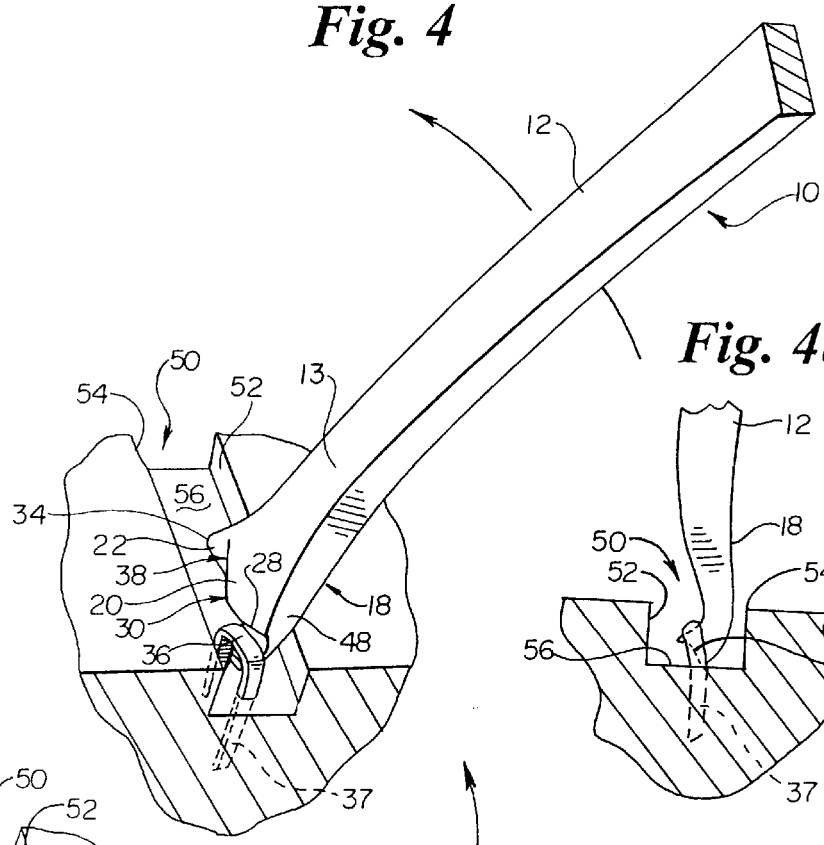
FIG. 4 is a perspective view of the tool of the subject invention as in FIG. 3, illustrating commencement of the prying action.
Figure 4A:
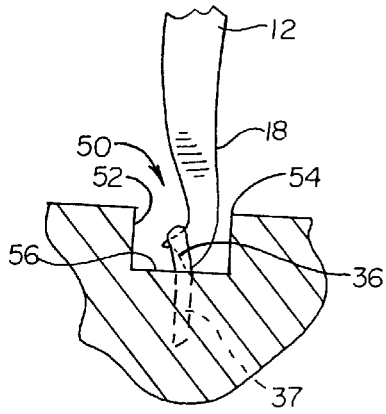
FIG. 4*a* is an elevational view of the tool as shown in FIG. 4.
Figure 5:
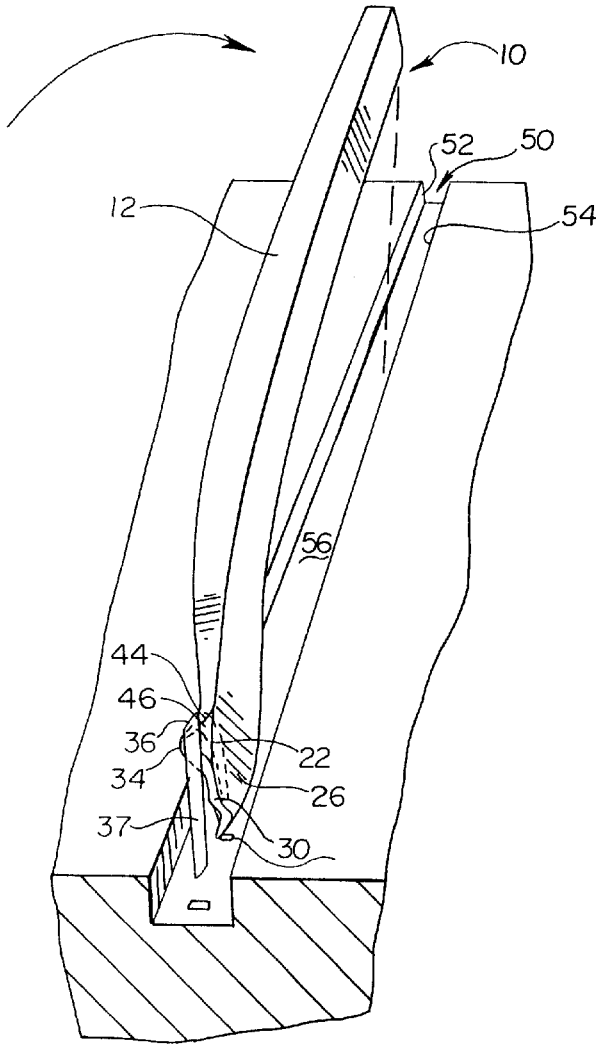
FIG. 5 is a perspective view of the tool of the subject invention as in FIG. 4, illustrating completion of the prying action.
Figure 5A:
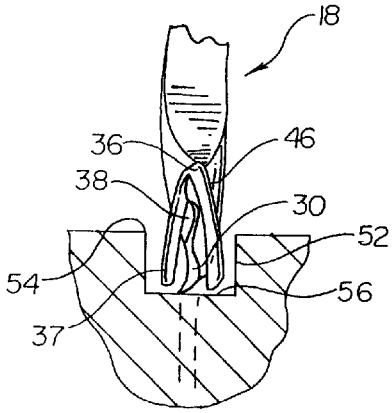
FIG. 5*a* is an elevational view of the tool as shown in FIG. 5.

Upon engaging and catching the bight 36 of the staple 35 and achieving a break or separation between the staple 35 and the work piece, the tool is pivoted to a substantially vertical position relative to the horizon (FIG. 4 & 4*a*). During the pivot motion, portions of the irregular perimeter 24 of the staple removing head 18 successively come into contact with the floor 56 of the channel 50 as the tool 10 vaults or rotates upon the tip 30 of the central projecting nose 20. Recalling that the tip 30 of the central projecting nose 20 is the forward most structure of the irregular perimeter 24 of the staple removing head 18, the vaulting effect lifts the lobe 22 caught under the bight 36 of the staple 35, and thereby furthers staple removal as one of the legs 37 of the staple 35 are pried from the work piece (FIGS. 4). Having reached a vertical position relative to the horizon (FIG. 4*a*), the tool 10 is further rotated down towards the channel 50 such that the non-staple engaging lobe 22 contacts the floor 56 of the channel 50 to effect complete removal of the staple 35 therefrom (FIGS. 5 & 5*a*).

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A tool for removing a staple having a crown portion and at least one leg portion, comprising:

(a) a shank having an axis of elongation and a distal end along said axis of elongation;

(b) a ramp, having a surface for engaging an underside of the crown portion of a staple, formed integrally with said shank proximate said distal end thereof, said ramp extending laterally with respect to said shank axis of elongation and having an axis angling away from said axis of elongation of said shank at an acute angle;

(c) a first fulcrum, integrally formed in said shank generally perpendicular to said axis of said ramp, about which said ramp can be rotated when said engaging surface abuts the underside of the crown portion; and, (d) a second fulcrum, integrally formed in said shank generally perpendicular to said axis of elongation of said shank, about which said ramp can be rotated when said engaging surface abuts the underside of the crown portion.

2. A tool in accordance with claim 1 wherein said axis of elongation is parallelally alignable with the crown portion of a staple to facilitate abutment of said engaging surface to the underside of the crown portion such that the staple is easily pried from a work piece without marring the surface thereof.

3. A tool in accordance with claim 2 wherein said engaging surface of said ramp is generally concave.

4. A tool in accordance with claim 3 wherein said ramp has a second surface angularly diverging, beginning at a tip of the ramp, from said engaging surface.

5. A tool in accordance with claim 4 wherein said engaging surface and said second surface of said ramp angularly diverge from one another at a relatively great degree.

6. A tool in accordance with claim 5 wherein said distal end of said shank deviates from said axis of elongation by about 15 degrees.

7. A tool in accordance with claim 6 further including a handle.

8. A tool in accordance with claim 1 further comprising an ear at the tip of the ramp and a revolving fulcrum, disposed generally on said axis of elongation of said shank, about which said ramp can be revolved with said ear engaging the underside of the crown portion of a staple.

9. A tool in accordance with claim 8 wherein said engaging surface and said ear angularly diverge from one another at a relatively great degree.

10. A tool in accordance with claim 9 wherein said ear has a textured edge, said textured edge enhancing retention of the crown portion of a staple on said ear while engaging the staple for removal from a work piece.

11. A staple removing tool comprising:

(a) a shaft having an axis of elongation and a distal end along said axis of elongation; and, (b) a staple removing head positioned at said distal end of said shaft and integral therewith, said staple removing head having a central projecting nose substantially aligned with said axis of elongation of said shaft, and staple prying ramps having a surface for engaging an underside of the bight portion of a staple, each of said ramps laterally extending with respect to, and spaced apart by, said central projecting nose so as to define an irregular perimeter for said staple removing head, said tool being laterally pivotable about a tip of said central projecting nose while one of said staple prying ramps abuts the underside of the bight portion of the staple.

12. A staple removing tool in accordance with claim 11 wherein said central projecting nose includes converging planar surfaces which merge with converging lateral edges so as to thereby form a flat tip for said central projecting nose.

13. A staple removing tool in accordance with claim 12 wherein said central projecting nose has a curved outer perimeter.

14. A staple removing tool in accordance with claim 13 wherein said flat tip of said central projecting nose is the forward most structure of said staple removing head.

15. A staple removing tool in accordance with claim 12 wherein each of said staple prying ramps have a generally concave surface.

16. A staple removing tool in accordance with claim 15 wherein each of said staple prying ramps have a rounded perimeter.

17. A staple removing tool in accordance with claim 16 wherein each of said staple prying ramps have an underside surface angularly diverging, beginning at a tip of said ramp, from said staple engaging surface.

18. A staple removing tool in accordance with claim 12 wherein said shaft is bent at about a 15 degree angle to facilitate the ergonomic prying of staples from a work piece.

19. A staple removing tool in accordance with claim 12 wherein said surface for engaging an underside of the bight portion of a staple further includes a textured portion to enhance retention of the bight portion of the staple thereon.

* * * * *